US008230833B2

(12) United States Patent
Werler et al.

(10) Patent No.: US 8,230,833 B2
(45) Date of Patent: Jul. 31, 2012

(54) VALVE TRAIN FOR INTERNAL COMBUSTION ENGINES FOR ACTUATING GAS EXCHANGE VALVES

(75) Inventors: Andreas Werler, Zwickau (DE); Thomas Arnold, Mitteldorf (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 0 days.

(21) Appl. No.: 13/262,938

(22) PCT Filed: Mar. 18, 2010

(86) PCT No.: PCT/DE2010/000331

§ 371 (c)(1),
(2), (4) Date: Oct. 5, 2011

(87) PCT Pub. No.: WO2010/115399

PCT Pub. Date: Oct. 14, 2010

(65) Prior Publication Data

US 2012/0037106 A1 Feb. 16, 2012

(30) Foreign Application Priority Data

Apr. 9, 2009 (DE) ..... 10 2009 017 242

(51) Int. Cl.
*F01L 1/04* (2006.01)

(52) U.S. Cl. ..... 123/90.6; 123/90.16; 123/90.44; 29/888.1

(58) Field of Classification Search ..... 123/90.16, 123/90.44, 90.6; 29/888.1
See application file for complete search history.

(56) References Cited

U.S. PATENT DOCUMENTS

| | | | | |
|---|---|---|---|---|
| 6,167,854 | B1 | 1/2001 | Regueiro | |
| 8,025,035 | B2 * | 9/2011 | Berger | 123/90.16 |

FOREIGN PATENT DOCUMENTS

| | | | |
|---|---|---|---|
| DE | 4107624 | A1 | 9/1992 |
| DE | 4230877 | A1 | 4/1993 |
| DE | 19520117 | A1 | 12/1996 |
| DE | 10054623 | A1 | 5/2002 |
| DE | 10148243 | A1 | 4/2003 |
| DE | 102004033800 | A1 | 2/2006 |
| DE | 102007016977 | A1 | 10/2008 |
| WO | WO 2007052686 | A2 | 5/2007 |

* cited by examiner

*Primary Examiner* — Ching Chang
(74) *Attorney, Agent, or Firm* — Leydig, Voit & Mayer, Ltd.

(57) ABSTRACT

A valve train for an internal combustion engine for actuating gas exchange valves includes a camshaft in the form of a camshaft tube driven by a crankshaft of the internal combustion engine. A selector shaft is disposed in the camshaft tube. A surface of the selector shaft includes a shifting contour having an axial gradient. At least one cam carrier is disposed on the camshaft and axially displaceable but rotationally fixed with respect to the camshaft. Each cam carrier includes an identical base-circle portion and a plurality of cam profiles. A rotationally fixed but axially displaceable shifting sleeve is disposed between the camshaft tube and the rotatable selector shaft of each cam carrier. Each shifting sleeve includes a hole. A shilling ball is disposed in the hole of each shifting sleeve. The shifting ball is coupled with the shifting contour of the selector shaft so as to be guided by the selector shaft so as to axially displace the shifting sleeve by rotation of the selector shaft. The shifting sleeve is operatively connected to the cam carrier via at least a driver for axial displacement of the cam carrier.

13 Claims, 4 Drawing Sheets

VALVE TRAIN FOR INTERNAL COMBUSTION ENGINES FOR ACTUATING GAS EXCHANGE VALVES

CROSS REFERENCE TO RELATED APPLICATIONS

This application is a U.S. National Phase application under 35 U.S.C. §371 of International Application No. PCT/DE2010/000331, filed on Mar. 18, 2010, and claims benefit to German Patent Application No. DE 10 2009 017 242.4, filed on Apr. 9, 2009. The International Application was published in German on Oct. 14, 2010 as WO 2010/115399 A1 under PCT Article 21 (2).

FIELD

The invention relates to a valve train for internal combustion engines for actuating gas exchange valves.

BACKGROUND

Gas exchange valves of an internal combustion engine can be operated in a variable manner with different opening and closing times and different valve opening lifts. A valve control system of this type is described in DE 42 30 877 A1. In this case, a cam carrier having two different cam contours is arranged on a camshaft in a rotationally fixed but axially displaceable manner. In accordance with the axial position of the cam carrier, a cam contour is operatively connected to the lift valve via an intermediate member (transfer lever). The axial displacement of the cam carrier for changing the valve parameters takes place during the base-circle phase against the effect of a return spring by means of a thrust collar.

A drawback in this case is the high installation space requirement needed for adjusting the cam carrier. These solutions can therefore only be used in the case of comparatively large cylinder spacings, in order to be able to accommodate the corresponding components. The high inertia forces which occur during the adjustment process and are required for displacing the cam carrier or the adjustment members are a further drawback. The changeover to a corresponding cam contour can only take place in a cylinder-selective manner. A valve-selective changeover is not possible.

DE 100 54 623 A1 describes a device for changing a cam carrier on a camshaft for actuating gas exchange valves, with which device the cam carrier is guided on the camshaft in an axially displaceable manner. In accordance with the position of the cam carrier, the gas exchange valve is operatively connected to different cam contours. The cam carrier is adjusted via an adjustment element in cooperation with a gate track. In this case, the adjustment element is a radially outwardly displaceable pin which when extended cooperates with at least two gate tracks formed in a guide part which is arranged through approximately 180° about the cam carrier.

A drawback of this solution, in addition to the additional installation space for the guide part, is that to change over to another cam contour the pin must be moved out of the camshaft and engaged in an axially displaceable shifting gate. After the shifting operation the pin must be moved in again. This construction is very expensive in terms of parts and production and there is the risk of damage to the camshaft by shifting errors of the pin. A further drawback is that the required adjustment time of the pin limits the engine speed. In addition, the adjustment depends on the oil pressure in each case.

DE 195 20 117 C2 also describes a valve train of an internal combustion engine, in which valve train an axially displaceable cam carrier comprising at least two different cam tracks is arranged on the camshaft in a rotationally fixed manner. The cam carrier is adjusted via an adjustment member which is guided inside the camshaft. The shaft-like adjustment member is displaced inside the camshaft against the pressure of a spring by a dual-action hydraulic or pneumatic piston-cylinder unit arranged at the end of the camshaft. The adjustment member is connected to a driving piece which penetrates an elongate hole arranged axially in the camshaft and discharges into a hole in the cam carrier.

The drawback of this solution is that it is only possible to displace a plurality of cam carriers arranged on the camshaft simultaneously via the axial displacement of the adjustment member. Different shifting of individual cam carriers on the camshaft is not possible. A further drawback is that the spring element is always tensioned in the case of a shift position in which an outer cam is engaged with the gas exchange valves. High lateral frictional forces therefore occur between the driving piece and the guide track arranged on the adjustment member. This results in increased wear and possible shifting errors associated therewith. A further drawback is that the acting spring forces must be set precisely in order to avoid shifting errors, in particular when shifting back to the medium cam profile in the case of three different cam profiles.

SUMMARY

In an embodiment, the present invention provides a valve train for an internal combustion engine for actuating gas exchange valves including a camshaft in the form of a camshaft tube driven by a crankshaft of the internal combustion engine. A selector shaft is disposed in the camshaft tube. A surface of the selector shaft includes a shifting contour having an axial gradient. At least one cam carrier is disposed on the crankshaft and axially displaceable but rotationally fixed with respect to the camshaft. Each cam carrier includes an identical base-circle portion and a plurality of cam profiles. A rotationally fixed but axially displaceable shifting sleeve is disposed between the camshaft tube and the rotatable selector shaft of each cam carrier. Each shifting sleeve includes a hole. A shifting ball is disposed in the hole of each shifting sleeve. The shifting ball is coupled with the shifting contour of the selector shaft so as to be guided by the selector shaft so as to axially displace the shifting sleeve by rotation of the selector shaft. The shifting sleeve is operatively connected to the cam carrier via at least a driver for axial displacement of the cam carrier.

BRIEF DESCRIPTION OF THE DRAWINGS

Exemplary embodiments of the drawings are described in more detail below with reference to the drawings, in which.

DETAILED DESCRIPTION

In an embodiment, an aspect of the present invention is to provide a valve train for actuating gas exchange valves of internal combustion engines, which valve train is characterised by a small installation space and using which a valve lift changeover can take place for each cylinder individually in a shiftable manner while avoiding shifting errors.

According to an embodiment of the invention, the displacement of the cam carrier for the valve changeover on the camshaft tube takes place via the rotatable selector shaft which is arranged inside the camshaft tube and is provided with a shifting contour having an axial gradient. A shifting ball is guided in the shifting contour, which shifting ball is mounted in a hole in an axially displaceable shifting sleeve surrounding the selector shaft. The shifting sleeve is operatively connected to the cam carrier via a driver. By rotating the selector shaft, the shifting sleeve is axially displaced via the shifting ball and the cam carrier is axially displaced via the driver. A reliable lift valve changeover thus takes place at low cost and requiring a small installation space.

By providing a back-pressure-loaded locking device which is provided with a locking contour for each shift position and is operatively connected to the cam carrier via a locking ball, shifting errors during displacement of the cam carrier are avoided. In addition, no lateral forces leading to increased wear occur after a shifting operation.

A shifting sleeve is associated with each individual cylinder of the internal combustion engine and is operatively connected to the selector shaft via the shifting ball which is guided in the shifting contour. A valve changeover can be carried out separately for the individual cylinders via an offset arrangement of the shifting contour which is provided with an axial gradient.

Figure 1:
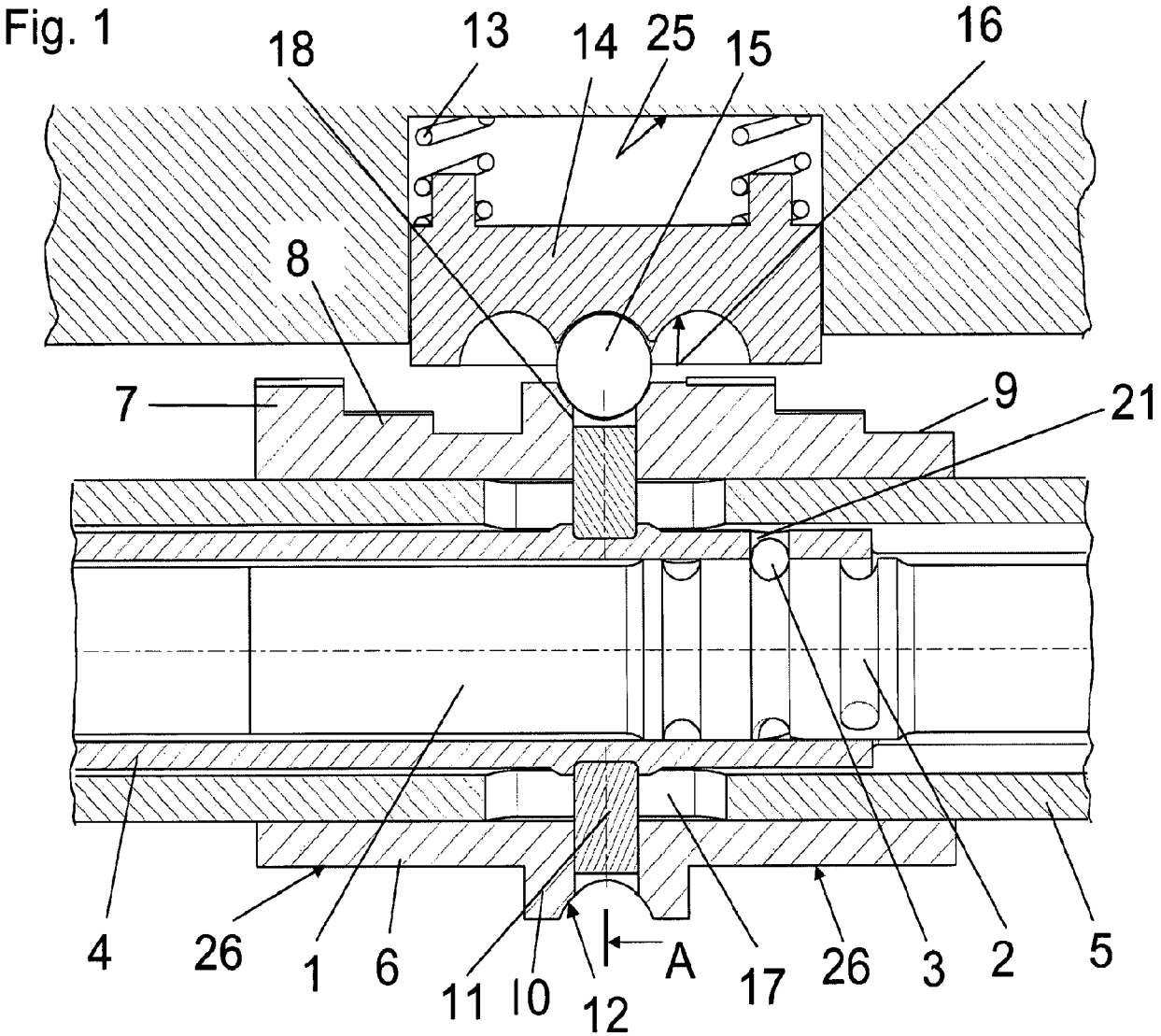
FIG. 1 is a sectional view of a cylinder for which a lift changeover can be carried out in accordance with an embodiment of the invention.

FIG. 1 is a sectional view of a portion of a valve train of an internal combustion engine. The valve train for actuating gas exchange valves consists of a camshaft which is driven by a crankshaft of the internal combustion engine and formed as a camshaft tube 5. A cam carrier 6 is arranged on the camshaft tube 5 in a rotationally fixed but axially displaceable manner. An axially displaceable cam carrier 6 is associated with each cylinder of a multi-cylinder internal combustion engine, which cam carrier can actuate two gas exchange valves of a cylinder in each case in accordance with the embodiment. The cam carrier 6 comprises, for the same base-circle portion 26, a plurality of different cam profiles 7, 8, 9, which are brought into contact with a respective gas exchange valve directly or via intermediate members for a valve lift changeover, optionally by displacing the cam carrier 6. In the embodiment shown the cam carrier 6 comprises three different cam profiles: a large cam profile 7, a medium cam profile 8 and a small cam profile 9. It is quite conceivable for the cam carrier 6 to comprise only two, or more than three different cam profiles. To achieve a phase displacement between the different cam profiles 7, 8, 9, the curves of the cam profiles 7, 8, 9 can be arranged offset from one another.

Figure 3:
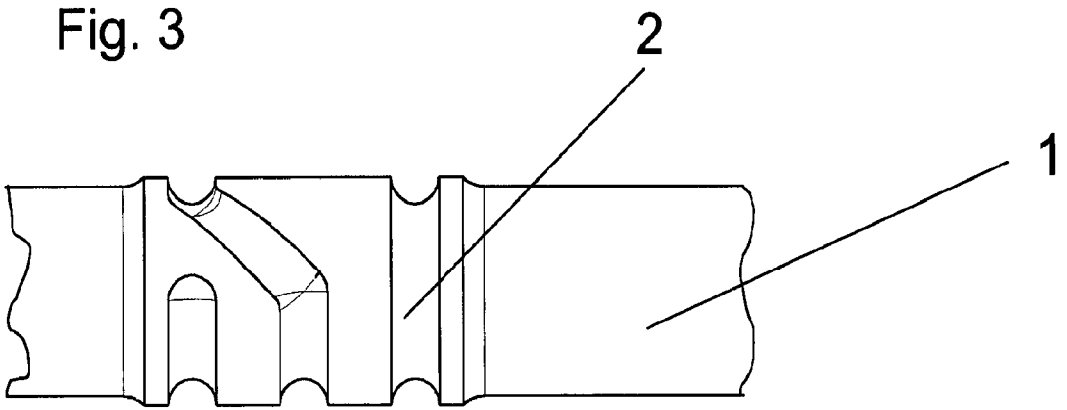
FIG. 3 is a partial view of a selector shaft.

For each cam carrier 6, a shifting sleeve 4 is arranged in a rotationally fixed but axially displaceable manner in the camshaft tube 5. A continuously rotatable selector shaft 1 is located inside the shifting sleeve 4. The selector shaft 1 is rotated in a controllable manner by a drive arranged at the end. In accordance with the shifting operation to be carried out for changing over the cam profiles 7, 8, 9 engaged with the gas exchange valves, the selector shaft 1 can be adjusted in one rotational direction or both rotational directions, as described in detail below. For each cam carrier 6, a shifting contour 2 provided with an axial gradient is arranged on the surface of the selector shaft 1. The axial gradient produces a spiral shifting contour 2 on the surface of the selector shaft 1. FIG. 3 shows a part of the selector shaft 1 comprising the spiral shifting contour 2 arranged on the surface of the selector shaft 1. The shifting contour 2 is operatively connected via a shifting ball 3 guided therein to the shifting sleeve 4. A hole 21 is arranged in the shifting sleeve 4, in which hole the shifting ball 3 is mounted. The shifting ball 3 is guided in the shifting contour 2 by rotating the selector shaft 1, the shifting sleeve 4 simultaneously being displaced axially on the selector shaft 1 via the shifting ball 3.

For the axial displacement of the cam carrier 6 and thus for the changeover between the individual cam profiles 7, 8, 9, the shifting sleeve 4 is operatively connected to the cam carrier 6 via at least a driver 11. The driver 11 is mounted in a seat 18 located in the cam carrier 6 on the one hand and is mounted slidingly in a peripheral guide track 22 arranged on the surface of the shifting sleeve 4 on the other hand. In this case, the driver 11 is formed as a driving pin, as shown in FIG. 1, or as a driving ball. In order to be able to carry out the respective shifting operations by the axial displacement of the cam carrier 6, for each driver 11 an opening 17 is arranged in the camshaft tube 5. The width of the opening 17 corresponds to at least the maximum axial displacement of the cam carrier 6. In FIG. 1 the cam carrier 6 is in a central position, in that in each case the medium cam profile 8 is engaged with the gas exchange valves.

The cam carrier 6 can only be displaced when the base-circle portion 26 is engaged with the gas exchange valve or the intermediate member. In order to avoid shifting errors, a locking device 14 is associated with each cam carrier 6. The locking device 14 is displaceably mounted in the cylinder block and is operatively connected to the respective cam carrier 6 via a locking ball 15. A back pressure which acts on the locking ball 15 is built up via the locking device 14. The back pressure is preferably produced by one or more springs 13 which are supported on the base 25 of the locking seat and rest against the base of the displaceable locking device 14. The back pressure in the space between the base 25 of the locking seat and the locking device 14 can also be produced by oil pressure, the pressure being adjustable via a control means.

In accordance with the number of different cam profiles 7, 8, 9, a respective dome-shaped locking contour 16, **16*a*, 16*b* is allocated in the locking device 14. When the medium cam profile 8 engages with the gas exchange valve, the locking ball 15 is mounted in the middle locking contour 16*a*. When the large cam profile 7 engages with the gas exchange valve, the locking ball 15 is mounted in the locking contour 16 and when the small cam profile 9 engages with the gas exchange valve the locking ball 15 is mounted in the locking contour 16*b***.

Figure 2:
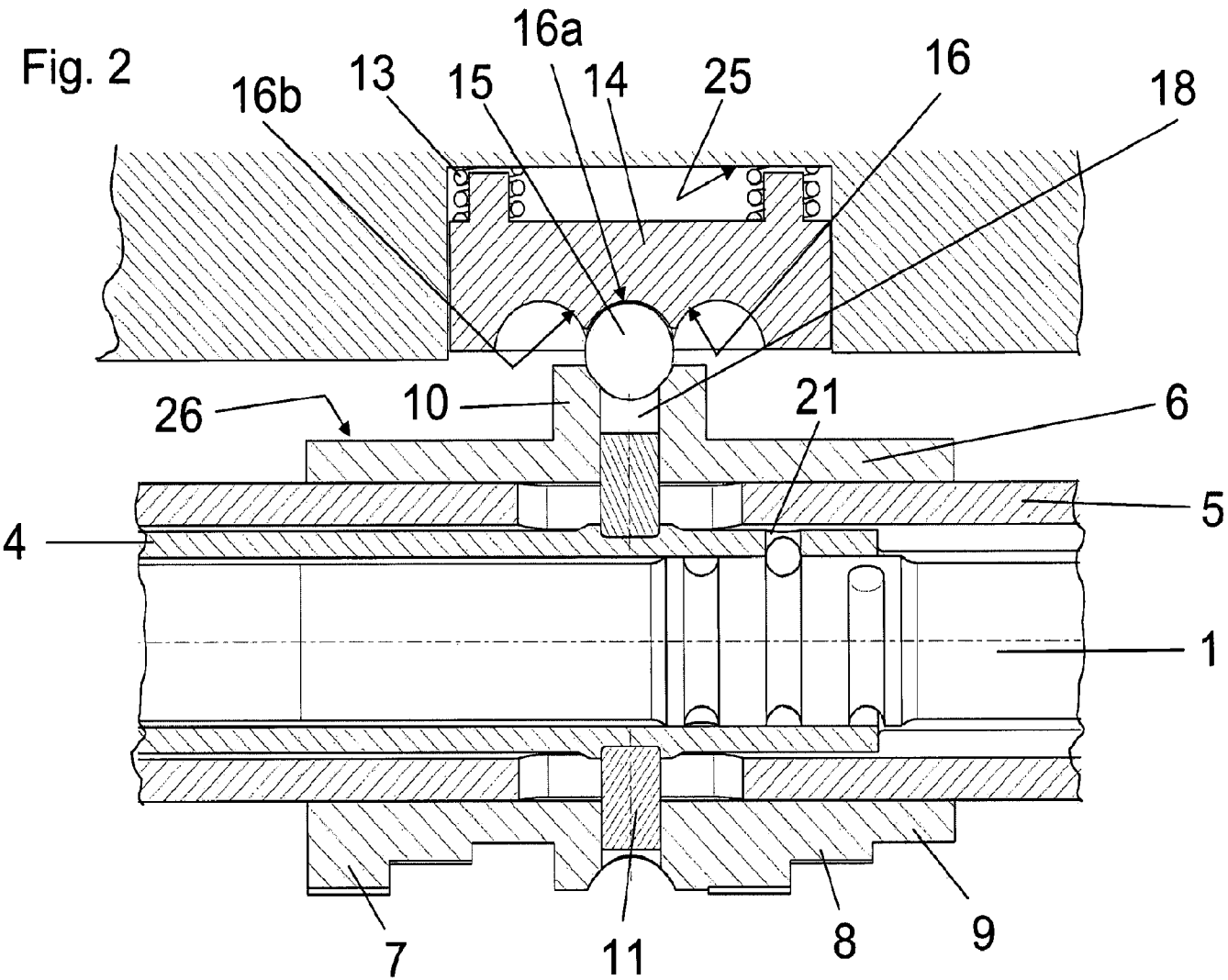
FIG. 2 is a sectional view a cylinder for which a lift changeover cannot be carried out in accordance with an embodiment of the invention.

A detent gate 10, which is provided with a peripheral contour 12 and in which the locking ball 15 is guided, is arranged on the cam carrier 6. The detent gate 10 is formed in such a way that, when a cam profile 7, 8, 9 engages with a gas exchange valve, the locking device 14 is displaced towards the base 25 of the locking seat by the locking ball 15 in such a way that the locking device 14 rests against the base 25 of the locking seat. This situation is shown in FIG. 2. In this case, the detent gate 10 comprises an elevation, whereby the locking ball 15 is moved towards the locking device 14. The maximum elevation of the detent gate 10 on the cam carrier 6 is located on the opposite side of the maximum cam elevation of the cam profiles 7, 8, 9.

Figure 5:
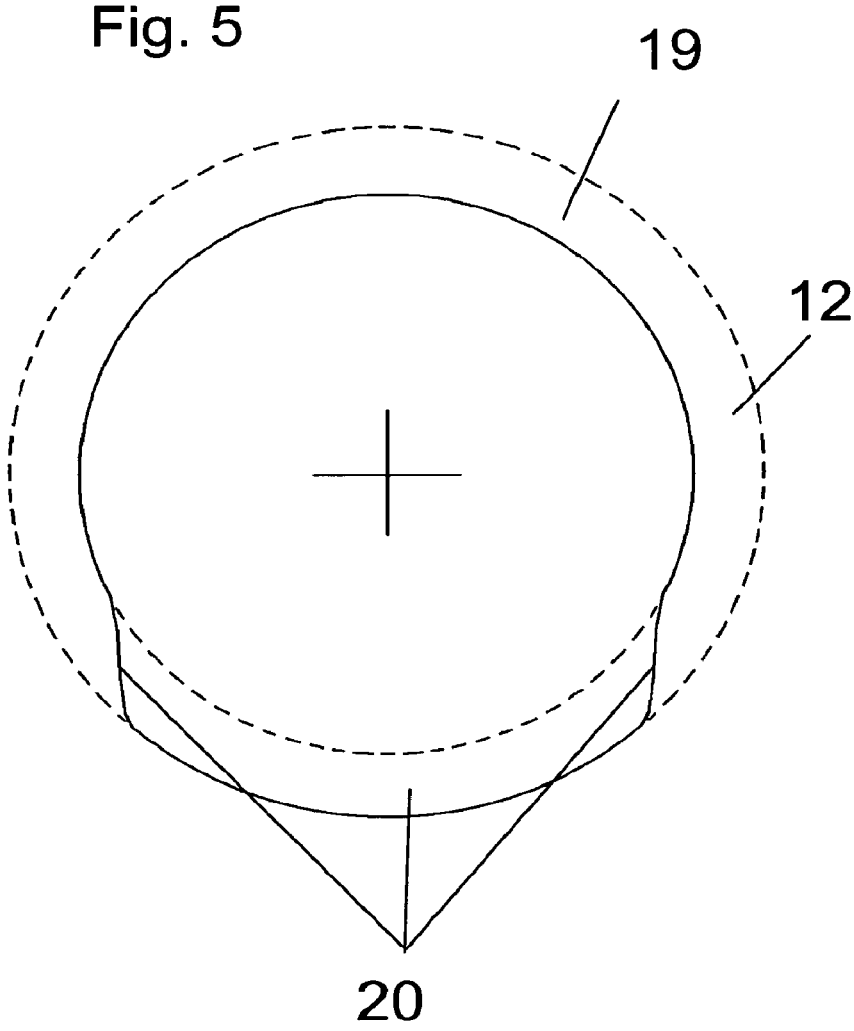
FIG. 5 is a view of the embodiment shown in FIG. 1

When the base-circle portion 26 engages with the gas exchange valve, the locking device 14 is spaced apart from the base 25 of the locking seat, as shown in FIG. 1. In this position an axial displacement of the cam carrier 6 can take place. By rotating the selector shaft 1 right or left from the position shown in FIG. 1, a changeover from cam profile 8 to cam profile 7 or to cam profile 9 takes place. When the selector shaft 1 is rotated, the shifting sleeve 4 is displaced axially on the selector shaft 1 via the shifting ball 3 guided in the shifting contour 2. An axial displacement of the cam carrier 6 also takes place via the driver 11 which is guided in the guide track 22 of the shifting sleeve 4 and is operatively connected to the cam carrier 6. Owing to the axial displacement of the cam carrier 6, a force which displaces the locking device 14 towards the base 25 of the locking seat against the force of the spring 13 acts on the edge of the locking contour 16*a* via the locking ball 15. As a result of the further axial displacement of the cam carrier 6 and the displacement of the locking device 14 towards the base 25, the locking ball 15 springs out of the locking contour 16*a* in accordance with the shifting operation carried out and into the locking contour 16*a* or 16*b*. The shifting operation is thus complete and the cam carrier 6 is retained securely in the new shift position by transferring the locking ball 15 into the locking contour 16 or 16*b*. By rotating the camshaft tube 5, the cam profile corresponding to the new shift position is operatively connected to the gas exchange valve, and the locking device 14 is again pressed against the base 25 by the detent gate 10 in connection with the locking ball 15. FIG. 5 shows a section through the detent gate 10 according to FIG. 1. The shifting region 19 in which a transfer between the individual cam profiles 7, 8, 9 can be carried out can be seen in FIG. 5. Reference numeral 20 denotes the blocking region in which the locking device 14 rests against the base 25 of the locking seat, as shown in FIG. 2, and in which no axial displacement of the cam carrier 6 can take place.

Figure 4:
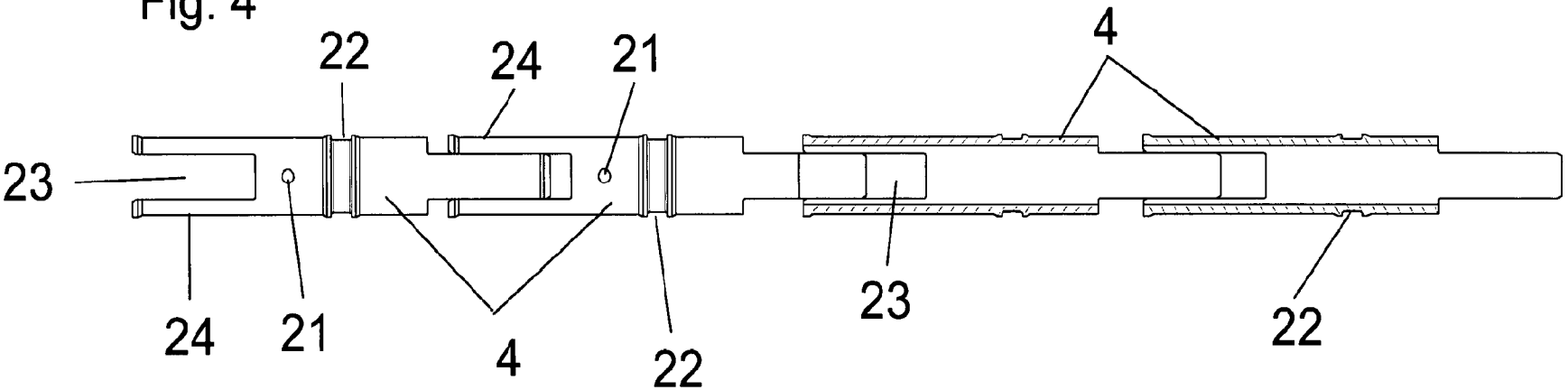
FIG. 4 is a view of the shifting sleeve for a four-cylinder internal combustion engine in partial section.

As described above, an axially displaceable cam carrier 6 and an axially displaceable shifting sleeve 4 are associated with each cylinder of the cylinders, arranged in a row, of an internal combustion engine. The shifting sleeves 4 mounted on the selector shaft 1 are provided with anti-twist protection. In addition, the individual shifting sleeves 4 are arranged on the selector shaft 1 in such a way that the individual shifting sleeves 4 are axially displaceable relative to one another. FIG. 4 shows four shifting sleeves 4 for a four-cylinder in-line engine. The sides of the shifting sleeves 4 are provided with a recess 23, forming two drivers 24 in each case. In this case, the two recesses 23 are arranged offset from one another, preferably by 90°, at the ends of the shifting sleeves 4, in such a way that when a plurality of shifting sleeves 4 are arranged on the selector shaft 1 the drivers 24 of two adjacent shifting sleeves 4 interlock. In this case, the drivers 24 of two shifting sleeves 4 interlock in such a way that an axial displacement of the shifting sleeves 4 relative to one another is possible.

Figure 6:
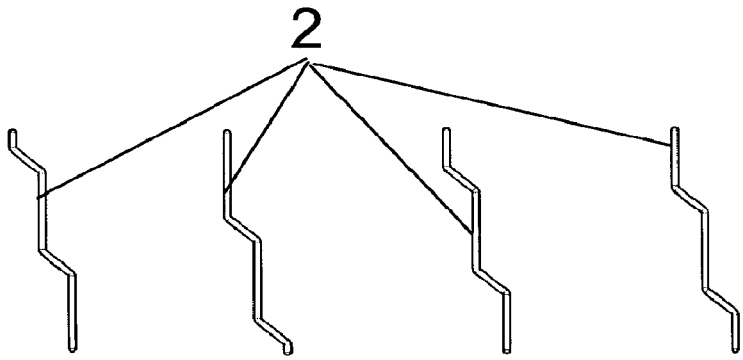
FIG. 6 is a development of the shifting contours located on the selector shaft.

By arranging the individual shifting contours 2 on the selector shaft 1, which shifting contours are operatively connected to the respective shifting sleeve 4 via the shifting balls 3, depending on the arrangement of the shifting contours 2 when rotating the selector shaft 1 for a valve changeover, a lift changeover can be carried out for all or a plurality of cylinders simultaneously or for each cylinder individually. When an axial displacement of the individual cam carriers 6 is to be carried out successively for individual lift adjustment of the individual cylinders, the individual axial gradients of the shifting contour 2 arranged for each cam carrier 6 are arranged offset from one another on the periphery of the selector shaft 1. FIG. 6 shows a development of the shifting contours 2 for a four-cylinder in-line engine in which the shifting processes can be carried out successively for each individual cylinder. By repeated rotation of the selector shaft 1 successively in one direction, an individual lift valve changeover takes place for each cylinder in succession. By rotating the selector shaft 1 in the opposite direction, the lift valve changeover is shifted back.

If necessary, a valve lift changeover can for example also be carried out jointly for two cylinders in each case. In this case, the offsets of the shifting contours 2 for the valve lift changeover to be carried out simultaneously match one another. In the case of a simultaneous valve lift changeover for all cylinders, for which the cam carriers 6 mounted individually on the camshaft tube 5 are displaced axially simultaneously, the individual axial gradients of the shifting contour 2 arranged for each cam carrier 6 on the periphery of the selector shaft 1 are in the same axial plane.

Through the variable arrangement of the shifting contours 2 on the selector shaft 1, valve lift changeovers adapted to the engine can also be carried out in a small required installation space. Shifting errors are avoided through the arrangement of the locking device 14 formed according to the invention in connection with the locking ball 15 and the detent gate 10.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS USED

1 selector shaft
2 shifting contour
3 shifting ball
4 shifting sleeve
5 camshaft tube
6 cam carrier
7 large cam profile
8 medium cam profile
9 small cam profile
10 detent gate
11 driver
12 contour
13 spring
14 locking device
15 locking ball
16 locking contour
16*a* locking contour
16*b* locking contour
17 opening
18 seat
19 shifting region
20 blocking region
21 hole
22 guide track
23 recess
24 driver
25 base of the locking seat
26 base-circle portion

What is claimed is:

1. A valve train for an internal combustion engine for actuating gas exchange valves, the valve train comprising:

a camshaft in the form of a camshaft tube driven by a crankshaft of the internal combustion engine;

a selector shaft disposed in the camshaft tube, a surface of the selector shaft including a shifting contour having an axial gradient;

at least one cam carrier disposed on the camshaft and axially displaceable but rotationally fixed with respect to the camshaft, each cam carrier including an identical base-circle portion and a plurality of cam profiles;

a rotationally fixed but axially displaceable shifting sleeve disposed between the camshaft tube and the rotatable selector shaft of each cam carrier, each shifting sleeve including a hole therein;

a shifting ball disposed in the hole of each shifting sleeve, the shifting ball being coupled with the shifting contour of the selector shaft so as to be guided by the selector shaft so as to axially displace the shifting sleeve by rotation of the selector shaft; and a driver, the shifting sleeve being operatively connected to the cam carrier via at least the driver for axial displacement of the cam carrier.

2. The valve train recited in claim 1, wherein each axially displaceable cam carrier is operatively connected to a back pressure-loaded locking device via a locking ball disposed in a peripheral contour of a detent gate of the cam carrier, the locking device including a dome-shaped locking contour associated with each cam profile of the axially displaceable cam carrier, and the locking ball being disposed in the locking contour upon completion of a shifting operation from one cam profile to another cam profile.

3. The valve train recited in claim 2, wherein the detent gate is configured so as to displace the locking device via the locking ball toward a base of a locking seat when a cam profile of the cam carrier engages with the gas exchange valve such that the locking device rests against the base of the locking seat, and such that the locking device is spaced apart from the base of the locking seat when the base circle portion of the cam carrier engages with the gas exchange valve, wherein during a shifting operation between respective cam profiles the locking device is displaced toward the base by the locking ball so as to provide a transfer of the lacking ball to a respective locking contour during axial displacement of the cam carrier.

4. The valve train as recited in claim 1, wherein the driver includes one of a driving pin and a driving ball, and is disposed in a seat located in the cam carrier and slidingly disposed in a peripheral guide track arranged on a surface of the shifting sleeve.

5. The valve train recited in claim 1, wherein the camshaft tube includes an opening corresponding to each driver.

6. The valve train as recited in claim 1, wherein the shifting sleeve includes an anti-twist protection disposed on the selector shaft corresponding to each cam carrier.

7. The valve train as recited in claim 1, wherein each shifting sleeve includes a mutually offset recess providing two sleeve drivers.

8. The valve train as recited in claim 7, wherein the shifting sleeves are disposed on the selector shaft such that sleeve drivers of respective shifting sleeves engage in the recess of an adjacent shifting sleeve.

9. The valve train as recited in claim 1, wherein the shifting sleeves are disposed on the selector shaft so as to be axially displaceable relative to one another.

10. The valve train as recited in claim 1, further comprising a drive configured to rotate the selector shaft in two rotational directions.

11. The valve train as recited in claim 1, wherein the axial gradients of the shifting contour corresponding to each cam carrier are offset from one another for successive axial displacement of the cam carriers.

12. The valve train as recited in claim 1, wherein the axial gradients of the shifting contour corresponding to each cam carrier are in a common axial plane for a simultaneous axial displacement of the cam carriers.

13. The valve train as recited in claim 1, wherein a sequence of an axial displacement of the cam carriers is adjustable based on an offset of the axial gradient of the respective shifting contours.

* * * * *